US011745197B2

(12) United States Patent
Lea et al.

(10) Patent No.: US 11,745,197 B2
(45) Date of Patent: Sep. 5, 2023

(54) DUAL COMPARTMENT CONTAINER ADAPTER

(71) Applicant: RUST-OLEUM CORPORATION, Vernon Hills, IL (US)

(72) Inventors: Peter Lea, Toronto (CA); Brian Bacik, Midhurst (CA); Jeff Hastie, Toronto (CA); Ladi Sujar, Mississauga (CA); Rasho Petrovic, Creek (CA)

(73) Assignee: RUST-OLEUM CORPORATION, Vernon Hills, IL (US)

( * ) Notice: Subject to any disclaimer, the term of this patent is extended or adjusted under 35 U.S.C. 154(b) by 0 days.

(21) Appl. No.: 16/643,810

(22) PCT Filed: Aug. 29, 2018

(86) PCT No.: PCT/CA2018/000159

§ 371 (c)(1),
(2) Date: Mar. 2, 2020

(87) PCT Pub. No.: WO2019/041021

PCT Pub. Date: Mar. 7, 2019

(65) Prior Publication Data

US 2021/0162440 A1 Jun. 3, 2021

(30) Foreign Application Priority Data

Aug. 30, 2017 (CA) ..... CA 2977635

(51) Int. Cl.
*B05B 11/00* (2023.01)
*B65D 83/20* (2006.01)
(Continued)

(52) U.S. Cl.
CPC ..... *B05B 11/0078* (2013.01); *B05B 11/1011* (2023.01); *B05B 11/1081* (2023.01);
(Continued)

(58) Field of Classification Search
CPC ..... B05B 11/0078; B05B 11/3011; B05B 11/3081; B05B 11/0008; B05B 11/0037; B65D 83/201; B65D 83/682
(Continued)

(56) References Cited

U.S. PATENT DOCUMENTS 2,941,696 A * 6/1960 Roger ..... B65D 83/68 222/136
3,674,180 A * 7/1972 Morane ..... B65D 83/682 222/145.5

(Continued)

FOREIGN PATENT DOCUMENTS

CA 2999391 A1 3/2017
WO 97/28834 A1 8/1997

OTHER PUBLICATIONS

The International Search Report (ISR) with Written Opinion for PCT/CA2018/000159 dated Oct. 3, 2018, pp. 1-8.

*Primary Examiner* — Vishal Pancholi
(74) *Attorney, Agent, or Firm* — McDonnell Boehnen Hulbert & Berghoff LLP

(57) ABSTRACT

An adapter receives two separate fluids from a container having two separate fluid compartments and combines the fluids into a single fluid stream for delivery to a spray fluid dispenser. The adapter comprises a unitary housing having a first open end for fluid connection to the container and a second open end for fluid connection to the spray fluid dispenser. The housing defines a manifold forming a fluid passageway therein between the first end and the second end. The manifold includes two separate first conduits formed at the first end. Each of the first conduits is connected to a respective one of the fluid compartments. The manifold further includes a second conduit in fluid communication with the second end for delivery of the combined fluids to the spray fluid dispenser. The first conduits are each in fluid communication with the second conduit.

20 Claims, 6 Drawing Sheets

(51) Int. Cl.
*B65D 83/68* (2006.01)
*B05B 11/10* (2023.01)

(52) U.S. Cl.
CPC ..... *B65D 83/201* (2013.01); *B65D 83/682* (2013.01); *B05B 11/0008* (2013.01); *B05B 11/0037* (2013.01)

(58) Field of Classification Search
USPC ..... 239/304
See application file for complete search history.

(56) References Cited

U.S. PATENT DOCUMENTS 3,786,963 A * 1/1974 Metzler, III ..... B05B 11/3081 222/136
5,009,342 A * 4/1991 Lawrence ..... B05B 11/3081 222/136
5,152,461 A * 10/1992 Proctor ..... B05B 11/0064 239/304
5,169,029 A * 12/1992 Behar ..... B05B 11/3084 128/200.23
5,398,846 A * 3/1995 Corba ..... B05B 11/3081 222/1
5,472,119 A 12/1995 Park et al.
5,769,275 A 6/1998 Boehmer et al.
6,659,311 B2 * 12/2003 Prueter ..... B05B 11/3081 222/136
6,843,390 B1 * 1/2005 Bristor ..... B05B 11/3081 222/145.5
2001/0025859 A1 10/2001 Dumont
2004/0206775 A1 * 10/2004 Holmes ..... B05B 11/00412 222/94
2006/0021996 A1 * 2/2006 Scott, III ..... A47G 19/2266 222/145.5
2010/0108779 A1 5/2010 Filsouf

* cited by examiner

DUAL COMPARTMENT CONTAINER ADAPTER

This application is a national stage application under 35 U.S.C. § 371 of International Application No. PCT/CA2018/000159, filed Aug. 29, 2018, which claims priority to Canadian Application No. 2,977,635, filed Aug. 30, 2017, the disclosures of which are explicitly incorporated by reference herein.

BACKGROUND AND SUMMARY OF THE DISCLOSURE

The present invention relates generally to adapters for use with a dual compartment container that stores two different fluids, and more particularly, to an adapter that receives the two separate fluids and combines the two fluids into a single fluid stream for delivery to a spray head dispenser for application of the combined fluids to a surface.

The present disclosure provides for an adapter having a manifold that allows for the combination of two different fluids, packaged separately in a dual compartment container, to be drawn into and combined into a single channel and dispensed from the container into a single stream for application in the form of a spray by a standard spray head dispenser.

There is a need for an adapter that easily combines two different fluids in a manner having accuracy of mixing and that does not require consumers to mix the fluids, thereby saving them time. For example, the different fluids may be fluids that are incompatible when formulated together due to chemically reactivity. Alternatively, the fluids could be fluids that can be compatibly stored together where it is beneficial to mix the fluids only immediately before use.

While there are several examples in the prior art of devices that allow multiple solutions to be combined into one stream, most of these devices are multi-component and cumbersome in design. There is a need for an adapter that comprises a single piece, thereby reducing the complication of assembly. There is a further need for an adapter having a simple single piece design that is efficient to manufacture through injection molding technology.

The present disclosure provides an adapter having a manifold for receiving two separate fluids from a container having two separate fluid compartments and for combining the fluids into a single fluid stream for delivery to a spray fluid dispenser. The adapter comprises a single housing with a manifold formed therein having two separate first conduits and a second conduit. Each of the first conduits receives one of the two respective fluids from the container. The first conduits connect to the second conduit for receiving and combining the two fluids. The second conduit leads to a spray dispenser which can apply the combined fluids to a surface.

In an illustrative embodiment of the present disclosure, there is provided an adapter for receiving two separate fluids from a container having two separate fluid compartments and for combining the fluids into a single mixed fluid stream for delivery to a spray head dispenser. The adapter comprises a unitary housing having a first end for fluid connection to the container and a second end for fluid connection to the spray head dispenser. The housing defines a manifold forming a fluid passageway therein between the first end and the second end. The manifold includes two separate substantially straight first conduits formed at the first end. Each of the substantially straight first conduits is connectable to a respective one of the fluid compartments for receiving fluid therefrom. The manifold further includes a second conduit in fluid communication with the second end for delivery of the combined fluids to the spray head dispenser. The first conduits each are in fluid communication with the second conduit.

In a further illustrative embodiment of the present disclosure, there is provided an adapter for receiving two separate fluids from a container having two separate fluid compartments and for combining the fluids into a single mixed fluid stream for delivery to a spray head dispenser. The adapter comprises a unitary housing having a first end for fluid connection to the container and a second end for fluid connection to said spray head dispenser. The housing defines a manifold forming a fluid passageway therein between the first end and the second end. The manifold includes two separate first conduits formed at the first end. Each of the first conduits is connectable to a respective one of the fluid compartments for receiving fluid therefrom. The manifold further includes a second conduit in fluid communication with the second end for delivery of the combined fluids to the spray head dispenser. The first conduits are each in fluid communication with the second conduit.

According to another illustrative embodiment of the present disclosure, there is provided an assembly for combining and dispensing two separate fluids. The assembly comprises a container comprising a first compartment for storing a first fluid and a separate second compartment for storing a second fluid; a spray head dispenser; and an adapter comprising a housing defining a manifold for receiving the first and second fluids from the container and for combining the fluids into a single fluid stream for delivery to the spray head dispenser. The housing has a first end connected to the container and a second end connected to said spray head dispenser. The manifold forms a fluid passageway between the first end and the second end. The manifold includes two separate substantially straight first conduits formed at the first end. Each of the substantially straight first conduits is fluidly connected to a respective one of the fluid compartments of the container. The manifold further includes a second conduit being connected to the second end for delivery of the combined fluids to the spray head dispenser. The first conduits each are in fluid communication with the second conduit.

Additional features and advantages of the present invention will become apparent to those skilled in the art upon consideration of the following detailed description of the illustrative embodiments exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

The embodiments of the invention described herein are not intended to be exhaustive or to limit the invention to precise forms disclosed. Rather, the embodiments elected for description have been chosen to enable one skilled in the art to practice the invention.

Figure 1:
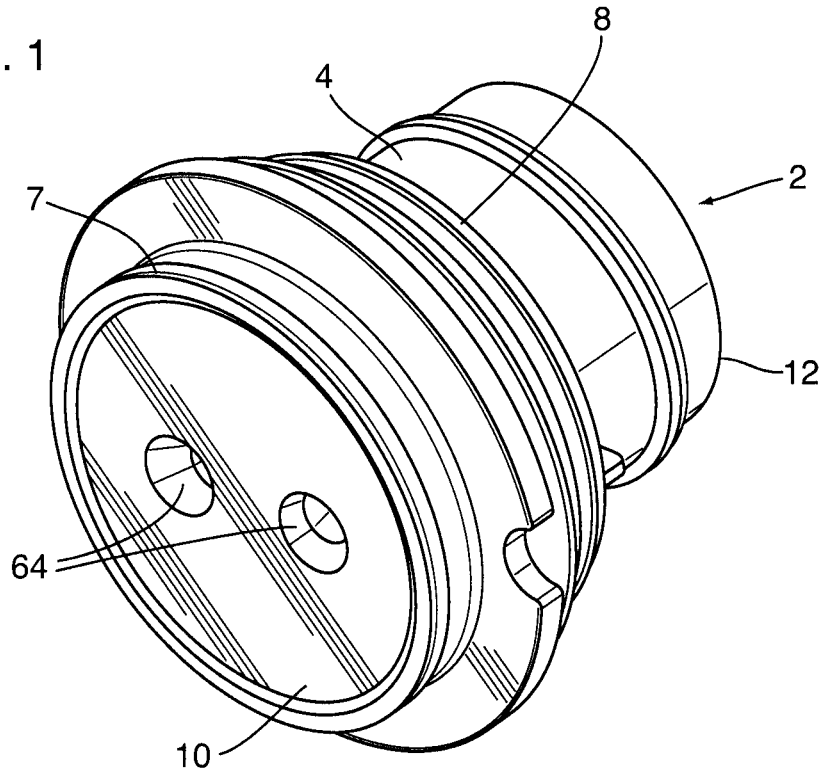
FIG. 1 is a bottom perspective view of an illustrative adapter.
Figure 5:
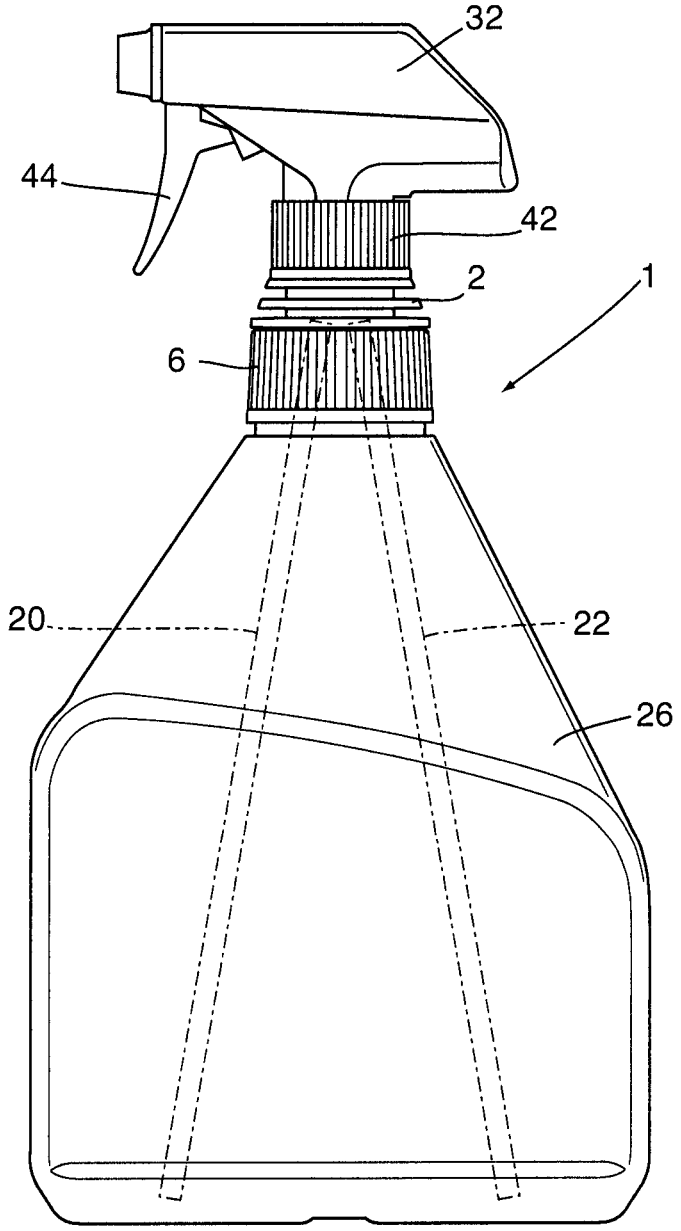
FIG. 5 is a side view of an assembly of the present disclosure.
Figure 6:
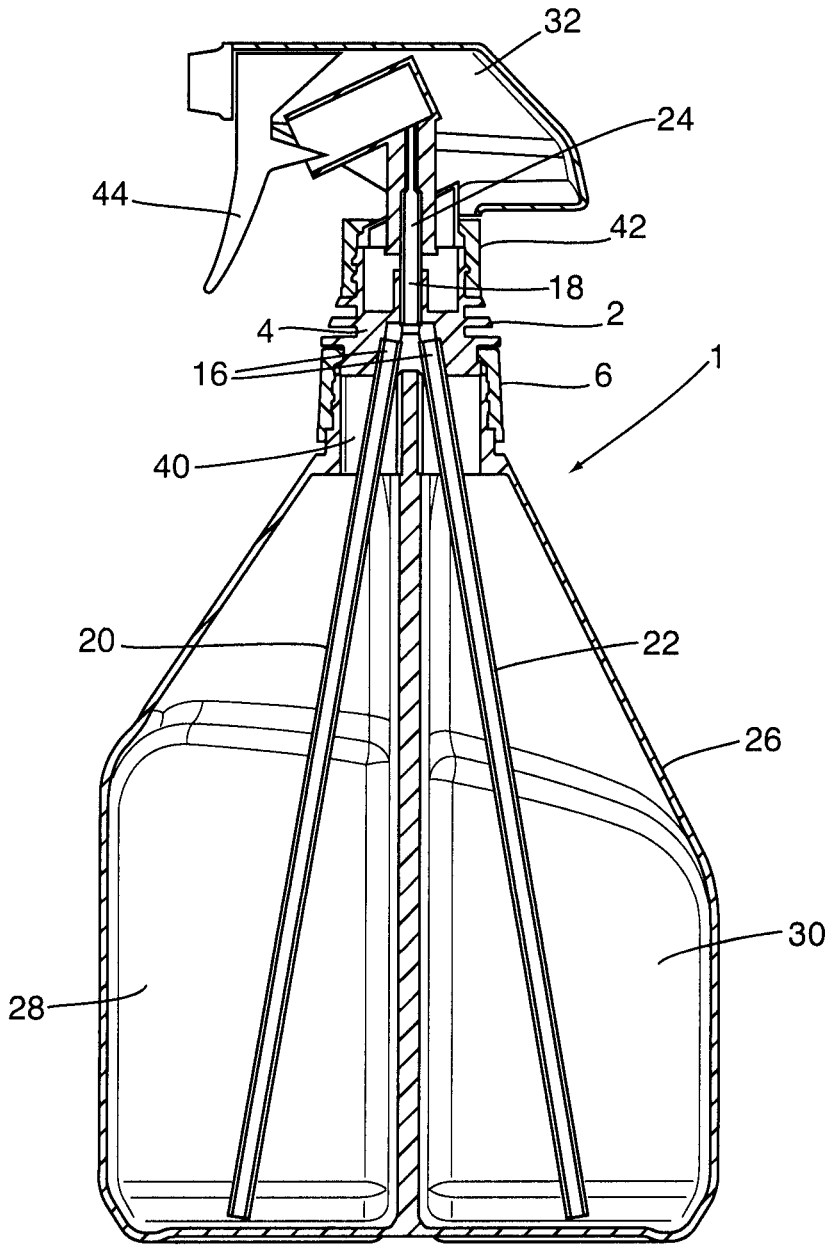
FIG. 6 is a cross-sectional view of the assembly of FIG. 5.
Figure 7:
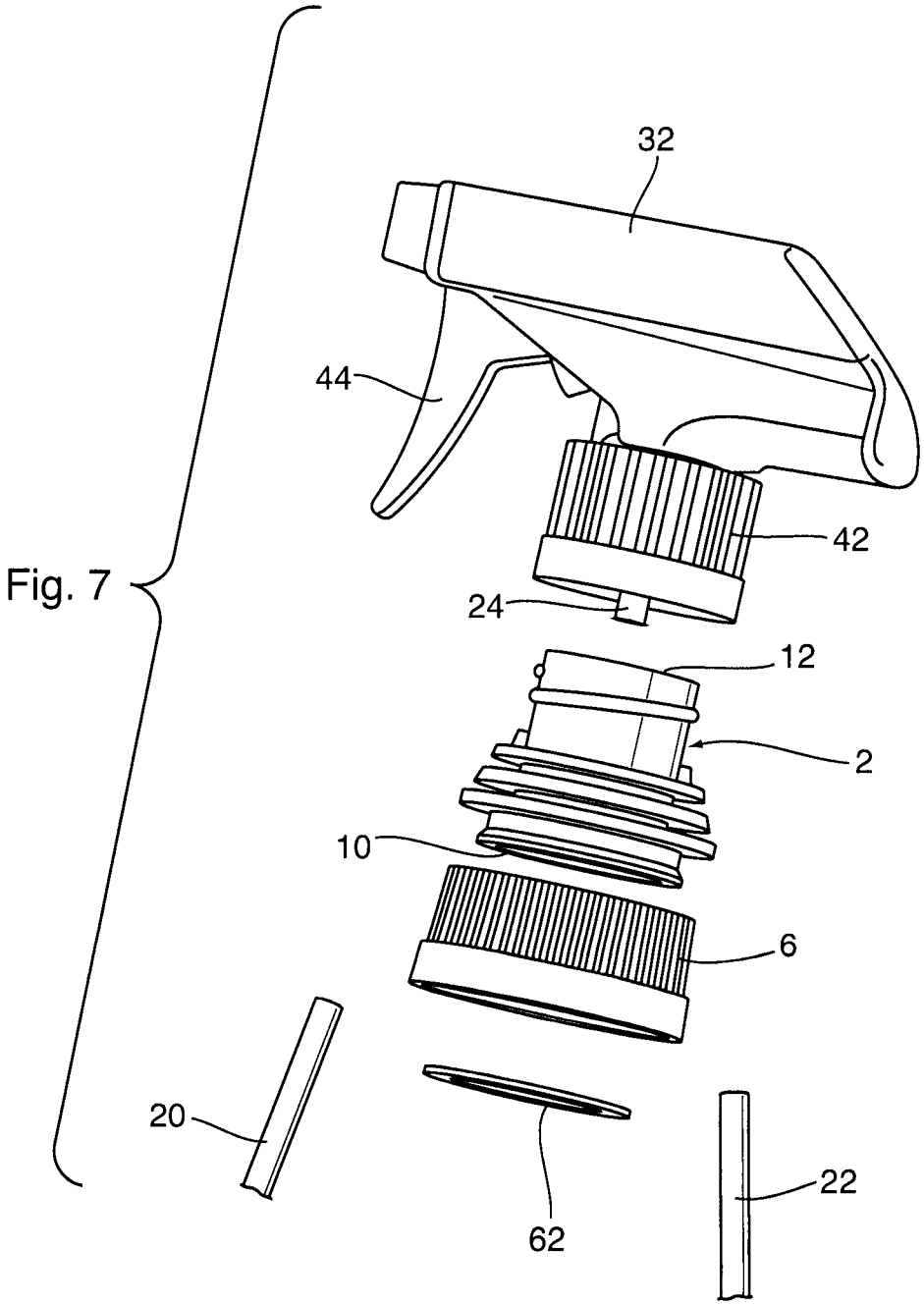
FIG. 7 is an exploded view of the assembly of the present disclosure.

With reference initially to FIG. 1, an illustrative adapter 2 according to the present disclosure is shown as including a housing 4. The housing 4 has a first end 10 for connection to a container 26 as shown in FIGS. 5 and 6. The first end 10 of the housing 4 is attachable to a collar 6 as shown in FIGS. 5, 6 and 7 for attachment to a neck 40 of a container 26 as shown in FIG. 6. The adapter 2 has a second end 12 for attachment to a conventional spray head dispenser 32 as shown in FIGS. 5, 6 and 7. The adapter 2 preferably includes fins 8. The adapter 2 includes a lip 7 around an outer circumference of the adapter 2 at the first end 10 of the housing 4 in order to force greater compression on a gasket 62 as shown in FIG. 7 to ensure a better seal with the container 26. The adapter 2 includes openings 64 in communication with first conduits 16 to receive dip tubes 20, 22 as shown in FIGS. 5, 6 and 7.

Figure 2:
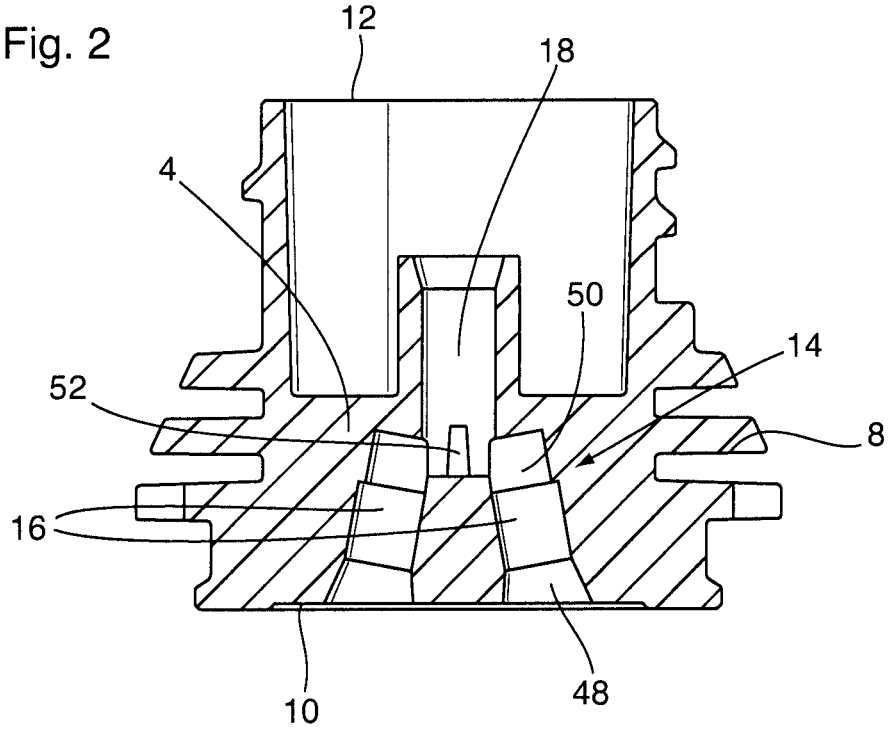
FIG. 2 is a cross-sectional view of the adapter of FIG. 1.

In the illustrative embodiment shown in FIG. 2, the housing defines a manifold 14 therein. The manifold 14 forms a fluid passageway between the first end 10 and the second end 12 of the adapter 2. The manifold 14 comprises two separate substantially straight first conduits 16. Each of the first conduits 16 communicates with an opening 64 for receiving fluid through the first end 10 of the housing 4. The manifold 14 further comprises a second conduit 18 in fluid communication with the second end 12 for delivery of fluids through an opening in the second end 12. The first conduits 16 are each in fluid communication with the second conduit 18. The first conduits 16 each have an opening (not shown) at a point of contact between each respective first conduit 16 and the second conduit 18. Similarly, the second conduit 18 has openings (not shown) at the points of contact with each of the respective first conduits 16. In the illustrative embodiment shown in FIG. 2, the respective first conduits 16 are substantially straight and angled relative to each other. In addition, the first conduits 16 are angled relative to the second conduit 18. Preferably, the angle between the two first conduits is in the range of about 15 degrees and about 35 degrees. Most preferably, the angle between the two first conduits is about 21 degrees. The first conduits 16 each have a lower portion 48 and an upper portion 50. The lower portions 48 are offset from the upper portions 50 to create separation between the two first conduits in order to accommodate the thickness of a division in the dual compartment container. The center of each of the first conduits 16 is offset by approximately 5.5 mm from the center of the second conduit 18 as shown in FIG. 2. There is preferably a gasket 62, as shown in FIG. 7, on the bottom of the adapter 2. The gasket preferably provides a seal between a division of the dual compartment container and the area between the two angled first conduits 16 that prevents the two liquids from mixing together.

The second conduit 18 forms a step 52 where the second conduit 18 connects to the first conduits 16. The step 52 is a difference in diameter between a portion of the second conduit 18 that leads to the spray dispenser and the part of the second conduit where the second conduit 18 meets the first conduits 16. The step 52 is beneficial so that a trigger tube, when inserted, will stop at a point that does not block the angled first conduits 16.

In the illustrative embodiment shown in FIG. 2, the angled first and second conduits eliminate any undercut areas below the conduits which is beneficial for injection molding processes for manufacturing the adapter. The housing of the illustrative embodiment shown in FIG. 2 also preferably does not include any hollow areas. This feature also provides for efficiency in manufacturing through injection molding processes. The housing 4 has fins 8 that improve cycle time in manufacturing through injection molding procedures.

Preferably, the height of the adapter of the embodiment shown in FIG. 2 is in the range of from about 23 mm to about 33 mm. Most preferably, the height of the adapter is 32.46 mm. The collar 6 is preferably in the range of from about 17.8 mm to about 25.5 mm in diameter. The diameter of the openings 64 is preferably about 4.4 mm.

Figure 3:
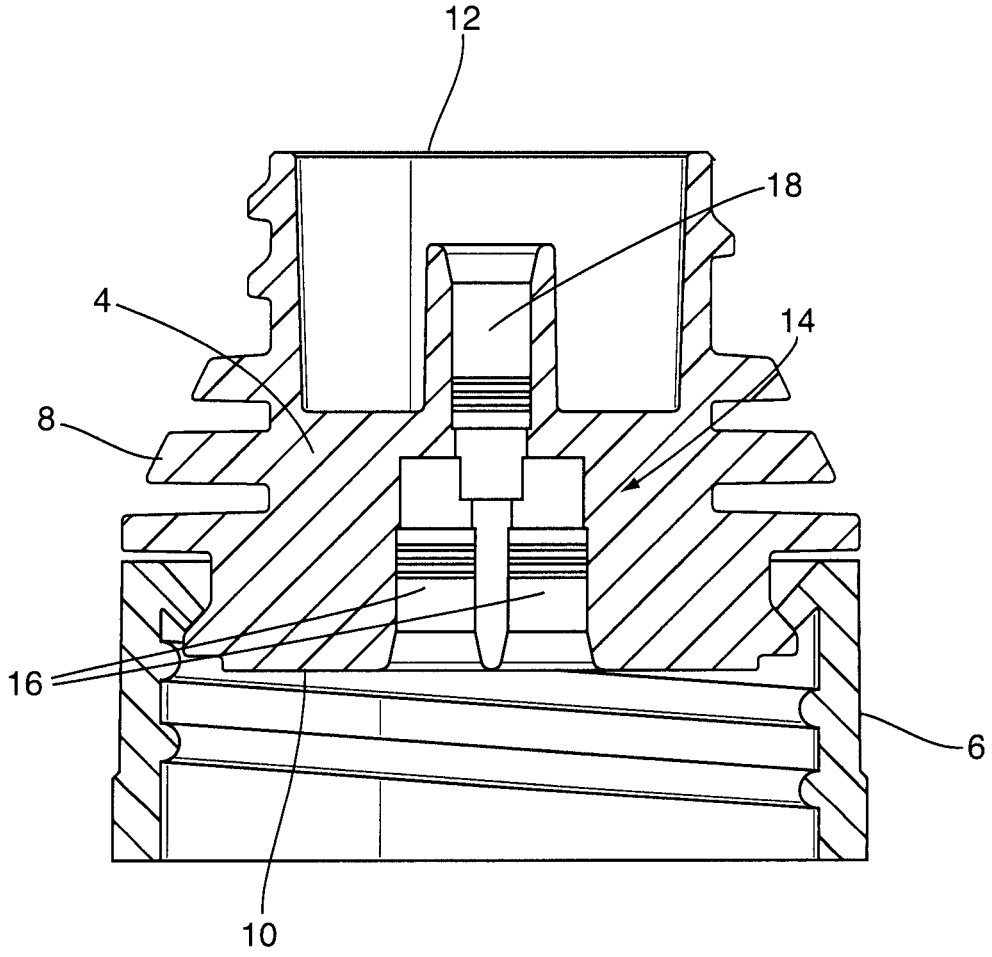
FIG. 3 a cross-sectional view of the adapter of FIG. 1 showing an alternate embodiment of the adapter of the present disclosure.

In the illustrative embodiment shown in FIG. 3, the housing 4 defines a manifold 14 therein. The manifold 14 forms a fluid passageway between the first end 10 and the second end 12. The manifold 14 comprises two separate substantially straight first conduits 16. Each of the first conduits 16 have open ends communicating with an opening 64 as shown in FIG. 1 for receiving fluid through the first end 10 of the housing 4. The manifold 14 further comprises a second conduit 18 in fluid communication with the second end 12 for delivery of fluids through the second end 12. The first conduits 16 are each in fluid communication with the second conduit 18. The first conduits 16 each have an opening (not shown) at a point of contact between each respective first conduit 16 and the second conduit 18. Similarly, the second conduit 18 has openings (not shown) at the points of contact with each of the respective first conduits 16. In this illustrative embodiment, the respective first conduits 16 are substantially parallel to each other. In addition, the first conduits 16 are substantially parallel to the second conduit 18.

Figure 4:
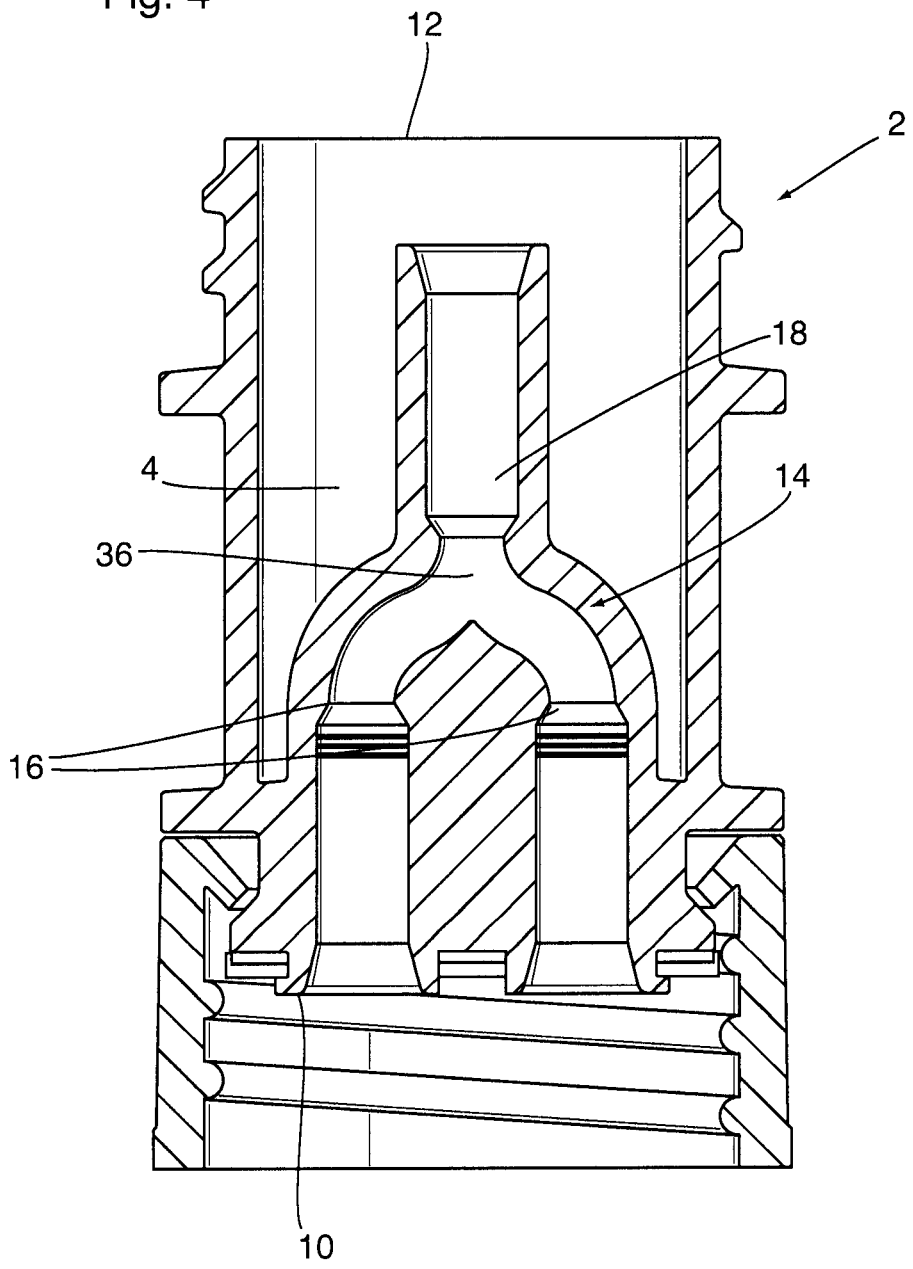
FIG. 4 a cross-sectional view of the adapter of FIG. 1 showing a second alternate embodiment of the adapter of the present disclosure.

In the illustrative embodiment shown in FIG. 4, the housing 4 defines a manifold 14 therein. The manifold 14 forms a fluid passageway between the first end 10 and the second end 12. The manifold 14 comprises two separate first conduits 16. The first conduits 16 each have a curved portion and join to form a U-shape. Each of the first conduits 16 have open ends communicating with an opening 64 as shown in FIG. 1 for receiving fluid through the first open end 10 of the housing 4. The manifold 14 further comprises a second conduit 18 in fluid communication with the second end 12 for delivering fluids through an opening in the second end 12. The first conduits 16 join to form a junction 36. The first conduits 16 join with the second conduit 18 at junction 36.

In the illustrative embodiment shown in FIGS. 5, 6 and 7, the adapter 2 is shown as part of an assembly comprising the adapter 2 as connected to the container 26 having a separate first compartment 28 and second compartment 30, and a standard spray nozzle 32 which functions as a spray head dispenser. The adapter 2 is shown in FIG. 6 as having the first conduits 16 and the second conduit 18 angled relative to each other as shown in FIG. 2. However other embodiments of the adapter 2 can be used as part of the assembly 1 including the embodiments shown in FIG. 3 and FIG. 4. The adapter 2 is fluidly connected to the container 26 at the first end 10. The first end 10 is attached to a neck 40 of the container 26. The collar 6 secures the first end 10 to the neck 40. A first dip tube 20 is received in one of the first conduits 16 as shown in FIGS. 5 and 6. A second dip tube 22 is received in the other of the first conduits 16 as shown in FIGS. 5 and 6. The first dip tube 20 extends from the first conduit 16 into the first compartment 28. The second dip tube 22 extends from the other first conduit 16 into the second compartment 30.

The second end 12 of the housing 4 of the adapter 2 is fluidly connected to the spray dispenser 32. The housing 4 is attachable to a collar 42 of the spray nozzle 32 for securing the adapter 2 to the spray nozzle 32. A third tube 24 extends from the second conduit 18 into the spray nozzle 32 as shown in FIG. 6 and FIG. 7.

As illustrated in FIG. 6, in operation, the dual compartment container 26 stores two liquids separately. A first liquid is stored in a first compartment 28 and a second liquid is stored in a second compartment 30. The two liquids may be chemically reactive liquids which cannot be stored after mixing due to chemical degradation. Alternatively, the two liquids could be liquids that could be stored together without degradation where it is nevertheless preferable to mix the liquids only immediately before use. It is necessary to combine these liquids only immediately before application to surface with a spray head dispenser. The adapter 2 fluidly connects the dual compartment container 26 to a standard spray nozzle 32 and combines the two fluids into a single fluid stream prior to delivery of the fluid stream to spray nozzle 32 for application of the combined fluid stream to a surface.

The actuation of the spray nozzle 32 is accomplished by pulling a lever 44 which generates suction through the third tube 24 which in turn generates suction through the first dip tube 20 and the second dip tube 22. The suction applied draws fluid from the first compartment 28 into the first dip tube 20. Likewise, the suction applied draws fluid from the second compartment 30 into the second dip tube 22. The fluid from the first dip tube 20 then flows into the first conduit 16. Likewise, the fluid from the second dip tube 22 then flows into the other first conduit 16. The fluids from the first conduits 16 both flow into the second conduit 18 by virtue of the fluid connection between the first conduits 16 and the second conduit 18. The two fluid streams from the first compartment 28 and second compartment 30 are therefore combined in the second conduit 18.

The suction generated by the spray nozzle 32 causes the combined fluid stream from the second conduit 18 to flow into the third tube 24. The fluid from the third tube 24 then enters the spray nozzle 32 and is dispensed onto a surface.

The design of the adapter of the present disclosure permits for efficient manufacturing of the adapter through injection molding techniques or by additive manufacturing processes including 3D printing.

Although the invention has been described in detail with reference to certain preferred embodiments, variations and modifications exist within the spirit and scope of the invention as described and defined in the following claims.

The embodiments of the invention in which an exclusive property or privilege is claimed are defined as follows:

1. An adapter for receiving two separate fluids from a container having two separate fluid compartments and for combining said fluids into a single mixed fluid stream for delivery to a spray fluid dispenser, said adapter comprising:

a unitary housing having a first end for fluid connection to the container and a second end for fluid connection to said spray fluid dispenser, the housing defining a manifold forming a fluid passageway therein between the first end and the second end, the manifold including two separate substantially straight first conduits formed at the first end, each of the substantially straight first conduits being connectable to a respective one of said fluid compartments for receiving fluid therefrom, the manifold further including a second conduit in fluid communication with the second end for delivery of the mixed fluids to the spray fluid dispenser, the first conduits each being in fluid communication with the second conduit and the second conduit forming a step where the second conduit connects to the first conduits, wherein the first conduits each have a lower portion and an upper portion, the lower portions being offset from the upper portions.

2. The adapter according to claim 1 wherein the second conduit is substantially straight and wherein the first conduits are angled relative to the second conduit.

3. The adapter according to claim 2 wherein an angle between the two first conduits is in the range of about 15 degrees and about 35 degrees.

4. The adapter according to claim 1 wherein the housing is made of plastic and the passageways are formed in the housing through injection molding.

5. The adapter according to claim 1 wherein separate first and second dip tubes are received in each of the two first conduits for receiving fluid from each of the two separate fluid compartments.

6. The adapter according to claim 5 wherein a third tube is received in the second conduit for delivering the single mixed fluid stream to the spray head dispenser.

7. The adapter according to claim 1 wherein the container is a bottle forming a neck at a top end thereof and the first end of the housing forms a collar for attachment to the neck of the bottle.

8. The adapter according to claim 1 wherein the spray head dispenser is a spray head and nozzle assembly.

9. The adapter according to claim 8 wherein a gasket is located between the housing and the spray head and nozzle assembly.

10. The adapter according to claim 1 wherein the housing defines two spaced apart openings formed on said first end, each of the openings being in fluid communication with one of said first conduits, each of the openings being adapted to receive a dip tube for receiving fluid from one of said two separate fluid compartments.

11. The adapter according to claim 1 wherein a lip is formed around an outer circumference of said first end the housing.

12. An adapter for receiving two separate fluids from a container having two separate fluid compartments and for combining said fluids into a single mixed fluid stream for delivery to a spray fluid dispenser, said adapter comprising:

a unitary housing having a first end for fluid connection to the container and a second end for fluid connection to said spray fluid dispenser, the housing defining a manifold forming a fluid passageway therein between the first end and the second end, the manifold including two separate first conduits formed at the first end, each of the first conduits being connectable to a respective one of said fluid compartments for receiving fluid therefrom, the first conduits join to form a junction, the manifold further including a second conduit in fluid communication with the second end for delivery of the mixed fluids to the spray fluid dispenser, the first conduits each being in fluid communication with the second conduit and join with the second conduit at the junction.

13. The adapter according to claim 12 wherein the first and second conduits are curved in profile.

14. The adapter according to claim 12 wherein the first conduits are connected to the second conduit to form a U-shape.

15. An assembly for combining and dispensing two separate fluids comprising:

a container comprising a first compartment for storing a first fluid and a separate second compartment for storing a second fluid;

a spray head dispenser; and an adapter comprising an unitary housing defining a manifold for receiving the first and second fluids from the container and for combining said fluids into a single mixed fluid stream for delivery to the spray head dispenser, said housing having a first end connected to the container and a second end connected to said spray head dispenser, the manifold forming a fluid passageway between the first end and the second end, the manifold including two separate substantially straight first conduits formed at the first end, each of the substantially straight first conduits being fluidly connected to a respective one of said fluid compartments of the container, the manifold further including a second conduit being connected to the second end for delivery of the mixed fluids to the spray head dispenser, the first conduits each being in fluid communication with the second conduit and the second conduit forming a step where the second conduit connects to the first conduits.

16. The assembly according to claim 15 wherein the housing defines two spaced apart openings formed on said first end, each of the openings being in fluid communication with one of said first conduits, each of the openings being adapted to receive a dip tube for receiving fluid from one of said two separate fluid compartments.

17. The assembly according to claim 16 wherein the second conduit is substantially straight and wherein the first conduits are angled relative to the second conduit.

18. The adapter according to claim 17 wherein an angle between the two first conduits is in the range of about 15 degrees and about 35 degrees.

19. The adapter according to claim 1, wherein the lower portions are offset from the upper portions to create separation between the two first conduits in order to accommodate the thickness of a division in the dual compartment container.

20. The adapter according to claim 1, wherein the step having a difference in diameter between a portion of the second conduit that leads to the spray dispenser and the part of the second conduit where the second conduit meets the first conduits.

* * * * *